US005089057A

United States Patent [19]

Plewes

[11] Patent Number: 5,089,057

[45] Date of Patent: Feb. 18, 1992

[54] METHOD FOR TREATING COPPER-BASED ALLOYS AND ARTICLES PRODUCED THEREFROM

[75] Inventor: John T. Plewes, Chatham, N.J.

[73] Assignee: AT&T Bell Laboratories, Murray Hill, N.J.

[21] Appl. No.: 584,392

[22] Filed: Sep. 17, 1990

Related U.S. Application Data

[63] Continuation of Ser. No. 408,443, Sep. 15, 1989, abandoned, which is a continuation-in-part of Ser. No. 70,010, Jul. 2, 1987, abandoned.

[51] Int. Cl.[5] ..... C22C 9/02; C22F 1/08

[52] U.S. Cl. ..... 148/12.7 C; 148/412; 420/473; 439/887

[58] Field of Search ..... 148/11.5 C, 12.7 C, 148/411, 412, 432, 433; 420/469, 473, 485; 439/887

[56] References Cited

U.S. PATENT DOCUMENTS

| | | | |
|---|---|---|---|
| 3,937,638 | 2/1976 | Plewes | 148/12.7 |
| 3,941,620 | 3/1976 | Pryor et al. | 148/12.7 |
| 4,052,204 | 10/1977 | Plewes | 148/433 |
| 4,073,667 | 2/1978 | Caron et al. | 148/12.7 C |
| 4,090,890 | 5/1978 | Plewes | 148/12.7 C |
| 4,260,432 | 4/1981 | Plewes | 148/2 |
| 4,434,016 | 2/1984 | Saleh et al. | 148/12.7 C |
| 4,732,625 | 3/1988 | Livak | 148/12.7 C |
| 5,019,185 | 5/1991 | Nakajima et al. | 148/11.5 C |

OTHER PUBLICATIONS

"Spinodal Decomposition in a Cu-9 wt % Ni-6 wt % Sn Alloy" Acta Metallurgica, vol. 22, 1974, pp. 601-609, by L. H. Schwartz et al.

"Spinodal Decomposition in Cu-9 wt % Ni-6 wt % Sn—II, A Critical Examination of the Mechanical Strength of Spinodal Alloys", *Acta Metallurgica,* vol. 22, 1974, pp. 911-921, by L. H. Schwartz et al.

"Spinodal Cu-Ni-Sn Alloys are Strong and Superconductile", Metal Progress, 1974, pp. 46, 47, 50, by J. T. Plewes.

*Primary Examiner*—R Dean
*Assistant Examiner*—George Wyszomierski
*Attorney, Agent, or Firm*—P. A. Businger; G. E. Books

[57] ABSTRACT

Copper based alloys, e.g. CuNiSnSi are processed by annealing followed by a high level of cold work area reduction then a recrystallization step which is followed by a low level of cold work prior to spinodal aging. The resultant material is isotropically formable while maintaining high yield strength.

16 Claims, 7 Drawing Sheets

METHOD FOR TREATING COPPER-BASED ALLOYS AND ARTICLES PRODUCED THEREFROM

This application is a continuation of application Ser. No. 07/408,443, filed on Sept. 15, 1989 , abandoned, which is a continuation-in-part of Ser. No. 070,010, filed July 2, 1987, now abandoned.

TECHNICAL FIELD

This invention relates to the processing of spinodal copper-based alloys to achieve optimum mechanical and electrical characteristics and to products made thereby.

BACKGROUND OF THE INVENTION

Spinodal copper-based alloys, e.g., spinodal copper-nickel-tin alloys have recently been developed as commercially viable substitutes for copper-beryllium and phosphor-bronze alloys which are currently prevalent in the manufacture of shaped articles such as electric wire, springs, connectors and relay elements. The equilibrium composition of these spinodal alloys is characterized in that such alloys are in a single phase state at temperatures near the melting point of the alloy but in a two-phase state at room temperature; the spinodal structure is characterized in that, at room temperature, the second phase is finely dispersed homogeneously throughout the first phase rather than being situated at the first phase grain boundaries. Among the alloy properties on which the aforementioned uses, as well as other uses, are based are: high strength; good formability; corrosion resistance; solderability and electrical conductivity. Spinodal Cu-Ni-Sn alloys exhibiting desirable combinations of properties are disclosed in U.S. Pat. No. 3,937,638; U.S. Pat. No. 4,052,204, reissued as U.S. Pat. No. Re. 31,180; U.S. Pat. No. 4,090,890; and U.S. Pat. No. 4,260,432, all in the name of J. T. Plewes.

U.S. Pat. No. 3,937,638 discloses a treatment of a Cu-Ni-Sn cast ingot which involves homogenizing, cold working, and aging which leads to a predominately spinodal structure in the treated alloy. For example, in the case of an alloy containing 7% Ni, 8% Sn and the remainder copper, an exemplary method calls for homogenizing the cast ingot, cold working to achieve 99% area reduction and aging for 8 seconds at a temperature of 425° C. The resulting article has a 0.01% yield strength of 173,000 psi and ductility of 47% area reduction to fracture.

U.S. Pat. No. 4,052,204 discloses quaternary alloys containing not only Cu-Ni-Sn but also at least one additional element selected from among the group consisting of Fe, Zn, Mn, Zr, Nb, Cr, Al and Mg. A predominantly spinodal structure is produced in these alloys by treatment of homogenizing, cold working and aging analogous to the treatment disclosed in U.S. Pat. No. 3,937,638.

U.S. Pat. No. 4,090,890, discloses cold rolled and aged strip material made of alloys having a composition similar to the composition of alloys disclosed in U.S. Pat. No. 3,937,638 and U.S. Pat. No. 4,052,204 and having not only high strength, but also essentially isotropic formability. As a consequence, such strip material is particularly suited for the manufacture of articles which require bending of the strip in directions having a substantial component perpendicular to the rolling direction.

U.S. Pat. No. 4,260,432 discloses Cu-Ni-Sn alloys further containing specified quantities of at least one member of the group consisting of Mo, Nb, Ta, V and Fe which is treated by a short time, low temperature anneal followed by a rapid quench, cold working (optional) with least 25% area reduction and aging. Since the alloys disclosed in this patent do not require cold deformation, such alloys are also suited for the manufacture of articles by hot working as well as cold working, casting, forging, extruding or hot pressing. The resulting articles are said to be strong, ductile and have isotropic formability.

Cu-Ni-Sn alloys and their properties are also a subject of the following papers: L. H. Schwartz, S. Mahajan and J. T. Plewes, "Spinodal Decomposition In A Cu-9 wt % Ni-6wt % Sn Alloy", "*Acta Metallurgica*, Vol. 22, May 1974, pp. 601–609; L. H. Schwartz and J. T. Plewes, "Spinodal Decomposition in Cu-9 wt % Ni-6wt % Sn-II. A Critical Examination of the Mechanical Strength of Spinodal Alloys", *Acta Metallurgica*, Vol. 22, July 1974, pp. 911–921; John T. Plewes, "Spinodal Cu-Ni-Sn Alloys are Strong and Superductile", *Metal Progress*, July 1974, pp. 46–50; J. T. Plewes, "High-Strength Cu-Ni-Sn Alloys by Thermomechanical Processing", Metallurgical Transactions A, Vol. 6A, March 1975, pp. 537–544.

Additionally, copper-based alloys containing Ni and Sn having good strength and bend properties is an object of a method disclosed in U.S. Pat. No. 3,941,620, issued to M. J. Pryor et al. Pryor et al discloses a method for treating an ingot by homogenizing, cold rolling, aging and again cold rolling. After aging, the sample is cooled slowly as opposed to being quenched.

This earlier work in the Cu-Ni-Sn system identified the occurrence, over a broad compositional regime, of two competing reactions during a low temperature aging sequence. The first reaction is the formation of the equilibrium ($\alpha+\gamma$) phase which nucleates discontinuously at the grain boundaries. There is a definite incubation time for this reaction to occur which is a function of cold work, aging temperature, aging time and composition. The second reaction is a continuous demiscibility process, termed spinodal decomposition, which occurs homogenously throughout the matrix. There is no incubation period for this process. Generally, the nucleation and subsequent growth of the $\alpha+\gamma$ phase occurs early in the spinodal transformation sequence. Since this reaction occurs initially at grain boundaries, the alloys are rendered brittle. It was later discovered as shown in the aforementioned patents, that a process which includes a cold working step with a high degree of cold work prior to the final low temperature aging sequence dramatically accelerates the kinetics of spinodal decomposition without significantly influencing the incubation time for the formation of the $\alpha+\gamma$ phase. Accordingly, at elevated levels of cold work, subsequent to the final low temperature age, the spinodal transformation can be made to go essentially to completion prior to the nucleation of the $\alpha+\gamma$ phase resulting in materials having excellent combinations of high strength and high ductility. The level of cold work typically employed to cause this effect is of the order of 75% for a Cu-9Ni-6Sn alloy.

Unfortunately, however, it is a general rule for copper alloys, (and, indeed for all metals) that cold rolling metal strip at levels of cold work in excess of 25–35% gives rise to a phenomenon termed "fibering", or "texturing". The terms are somewhat misleading, as we shall further discuss, however, associated with this cold work texturing are differences in ductility (anisotropy in formability) depending on the test direction in the sheet. As the level of cold work exceeds 40%, serious degradation in transverse formability occurs, i.e., the ability to form the material with its bend axis parallel to the original rolling direction requires more and more generous bend radii.

This anisotropy is primarily due to grain elongation in the direction of rolling. The grain boundary area represents a plane of weakness for cracks to nucleate.

Concomitant with this grain elongation is a rotation of preferred (easy) slip plans within the grain giving rise to the development of a preferred crystallographic rolling texture which may further aggravate this transverse formability. Typically, in most copper alloys significant transverse anisotropy in formability is observed to occur when the grain size aspect ratio (ratio of the length to the width) approaches 1.3 to 1.5. As one continues to plastically deform the metal to higher levels of cold work, anisotropy rapidly increases. At 75% cold work, one may observe in excess of an order of magnitude difference in formability depending on the direction of test within the sheet.

Typically, for copper-based alloys, the "brass" texture develops at these elevated levels of cold work. This texture is characterized as a (110)<112> texture in which a preponderance of (110) planes are parallel to the rolling plane and they, in turn, are orientated such that their <112> direction is parallel to the sheet rolling direction.

It can therefore be seen that, elevated levels of cold work have been required to accelerate the spinodal transformation and develop high strength. The materials so processed exhibit excellent ductility either in wire form or in sheet longitudinally, but exhibit very poor transverse sheet ductility due primarily to both grain elongation effects and to the brass texture development inherent at these levels of cold work.

To avoid this phenomenon in strip, one must reduce the level of cold work prior to final aging while still attaining the essentially complete spinodal transformation required to attain high strength. This has been achieved, for example, in the Cu-Ni-Sn alloys containing prescribed amounts of Mo, Ta, Va or Fe included therein (U.S. Pat. No. 4,260,432). Commercially, however, these alloys cannot be readily thin slab cast in air due to the very high reactivity of these quaternary additives with oxygen which tend to react rapidly and slag to the surface during melting. This adversely effects the mechanical properties of the alloy. In order to prevent this, processing under a static vacuum or deoxygenated system would be necessary. Consequently, there is still a need in the art to achieve a high strength spinodal Cu alloy which is isotropically ductile and formable in strip form, and which can be made by typical air melting techniques.

In summary, in order to develop high strength isotropic material, apparently, two possible directions exist:

(1) To accelerate the spinodal decomposition process allowing it to develop to a further extent prior to nucleation of the discontinuous embrittling grain boundary reaction.

(2) To inhibit nucleation of the discontinuous reaction.

In either case, this must be accomplished without the grain elongation and brass texturing associated with high levels of cold work prior to final low temperature aging sequence.

Fourth element additions made to the Cu-Ni-Sn system in an attempt to effect (1) resulted in a spinodal demiscibility that was either unaffected or negatively affected (i.e., the transformation kinetics were retarded).

Detailed examination (transmission electron microscopy) at the onset of the nucleation of the discontinuous $\alpha+\gamma$ transformation suggested that this process appears to occur at preferred crystallographic grain boundary sites. This observation is entirely consistent, thermodynamically. In principle, if the statistical number of these preferred sites could be reduced, nucleation should be retarded.

I have now discovered that by inducing a preferred enhanced recrystallization texture (as hereinafter defined) in the alloy prior to final aging, one can significantly suppress the onset of the $(\alpha+\gamma)$ embrittling reaction at the grain boundaries (i.e., the nucleation time for sigmoidal onset occurs at significantly longer aging times). Since the kinetics of the demiscibility process are insensitive to crystallographic orientation this process is unaffected and proceeds normally.

Accordingly, the spinodal transformation can proceed to a further extent, i.e., higher strengths can be achieved prior to the onset of embrittlement. Surprisingly, this can be achieved at low levels of final cold work (0–35%) before aging while still attaining (after low temperature aging) essentially complete spinodal decomposition. These levels of cold work are sufficiently low enough such that negligible anisotropy in formability is observed. Since highly reactive additions are not required, the alloy can be commercially air processed.

It should be emphasized, that this discovery is in opposition to what one would expect based upon prior art teaching. In general, commercial practice dictates an extended high temperature annealing cycle to promote a random recrystallization texture. In this teaching, the presence of a metastable recrystallization texture is the key in effecting the retardation of the embrittling reaction, and hence a high strength, highly ductile isotropic material is attained.

SUMMARY OF THE INVENTION

An article of manufacture comprises an essentially isotropically ductile and formable spinodal copper-based alloy having an enhanced recrystallization textured matrix. The invention further includes thermomechanical processes for achieving articles having such recrystallization texture.

DETAILED DESCRIPTION

Figure 2:
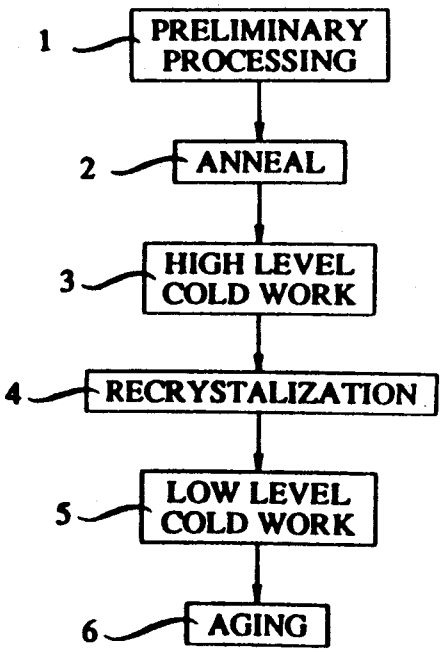
FIG. 2 is a processing flow diagram.

Definitions—before proceeding with the detailed description, for the purpose of clarity, the following definitions of terms as used herein are provided.

Cold working—as used herein includes one or more cold working steps such as rolling, swaging, extruding, drawing, etc. uninterrupted by intermediate anneals.

Recrystallization—the development of strain free equiaxed grains from a cold worked structure.

Anneal—an elevated temperature heat treatment wherein the prior cold worked matrix of the alloy is heated to an elevated temperature and held for sufficient time such that complete recrystallization occurs.

Homogenization—a heat treatment wherein the alloy is heated to an elevated temperature and held for a sufficient time and quenched sufficiently rapidly such that an essentially supersaturated single phase is retained at room temperature.

Aging—a relatively low temperature heat treatment (250° C.-500° C.) wherein the initially supersaturated solid solution is allowed to decompose to more than one phase. One or more phase transformations can occur, either concurrently, or consecutively, depending on alloy chemistry, prior cold work, time and temperature.

Texture—the presence of a preponderance of grains, beyond the predicted statistical norm, of a particular crystallographic orientation. This may result, most commonly, from cold deformation, in which certain (easy) slip directions predominate. In this case, the grains are elongated, i.e., their aspect ratio (length/width) is $>1$. The rolling texture most typically observed in copper alloys is the "brass texture" which is a (110)<112>(110 planes are developed parallel to the rolling plane with <112> orientations parallel to the rolling direction). It is also possible to develop a recrystallization texture with appropriate thermomechanical processing techniques. In this case, the grains are essentially equiaxed, i.e., their aspect ratio $=1$.

Ductility—the ability of a material to undergo extensive localized plastic defomation. The typical method of measuring ductility is by measuring percent elongation in a tensile test, however, this is not a particularly good method as it does not necessarily reflect localized directional ductility variations (anisotropy). Better measures to ductility are reflected by either the percent reduction in area on fracture, or by a localized bending test, taken in different directions relative to the rolling direction in the sheet.

Minimum Bend Radius (MBR)—is a measure of the ability of a material to be bent either 90 or 180 degrees around a series of prescribed mandrels with controlled radii. The smaller the radius of the mandrel, the better the localized ductility. The typical measure is quoted as the ratio of the bend radius over the sheet thickness. (The lower the MBR the more ductile the alloy.) I shall be employing the more conservative 180 degree bend.

Bend Anisotropy—is a measure of the difference in the MBR as a function of orientation in the sheet. The primary cause of bend anisotropy is the level of prior cold work in the material, and the degree of anisotropy generally increases rapidly at levels of cold work in excess of 40 percent.

Yield Strength—is a measure of the stress required to effect a given level of permanent strain. The level of strain must be specified. As the level of offset strain is reduced, the yield strength tends to be a rough measure of the elastic limit of the alloy (below which the material acts completely elastically) and is an important parameter in the design of springs and connectors which should act elastically.

The typical yield strength quoted commercially is the 0.2% yield strength, however, this reflects rather significant strain, and for alloys exhibiting high strain hardening rates (e.g., CuBe) can be as much as 40% higher than the elastic limit. Clearly, this level of strain is not a good estimate of the elastic limit. A more appropriate offset yield would be 0.01-0.05%. I use the yield strength at 0.01% strain, which is a much better estimate (within 4-7%) of the elastic limit.

FRACTURE TOUGHNESS

A measure of the total energy required to fracture. The fracture toughness is calculated by integrating the total area under the stress-strain curve in a tensile test. A fairly accurate relative estimate can be obtained by taking half the sum of the 0.2 percent yield plus the ultimate tensile strength and multiplying by the total elongation to fracture. This estimate is most valid when comparing materials with similar work hardening behavior.

SPINODAL DECOMPOSITION

A homogeneous, diffusion controlled, demiscibility process which occurs from a supersaturated solid solution whose median composition and temperature are within the coherent spinodal of a miscibility gap within the two phase region of the alloy and which leads to a dispersement of a second phase homogeneously throughout the first phase, and wherein a supersaturated α phase metastably decomposes to two new α phase differing in lattice parameter from each other and from the original α phase but exhibiting the same crystallographic structure. This resulting structure is compositionally sinusoidal in character.

COMPOSITIONS

In order to form a copper-based alloy, e.g., a Cu-Ni-Sn, alloy having a desired recrystallization texture, (i.e., enhanced as compared with a random texture) one must employ alloys which are compositionally suitable and which are processed in a specified manner. For each compositional range, there exists optimum values for the processing variables.

By way of example, the useful compositional range for an alloy consisting essentially of Cu, Ni and Sn is Cu having 3–20 wt % Ni and 3.5–7 wt % Sn (together with unavoidable impurities). Outside of this range of compositions it is not possible to develop the desired metastable recrystallization texture. This useful range is shown as the shaded area of FIG. 1. It should be noted that with the addition or substitution of other materials, e.g., silicon, this range, as well as the particular processing parameters will shift in order to achieve the desired recrystallization texture. While the addition of silicon is considered to be particularly effective for the sake of broadening preferred time and temperature ranges in recrystallization processing as described below, other additives such as, e.g., titanium, hafnium, zirconium, or a lanthanide element may also be used for this purpose, individually or in combination, in a preferred (combined) amount of up to 0.3 weight percent. Beneficial also, for the sake of enhancement of desired texture, is the addition of iron or cobalt, in a preferred (combined) amount up to 1.5 weight percent, and preferably at least 0.4 weight percent. Considered as tolerable, without undue interference with preferred ultimate material properties, are the inclusion of manganese in a preferred amount of up to 5 weight percent, zinc in a preferred amount of up to 25 weight percent, aluminum in a preferred amount of up to 3 weight percent, and magnesium in a preferred amount of up to 1 weight percent. For purposes of the example herein, the processing parameters will be shown with respect to alloys consisting essentially of Cu, Ni and Sn and particularly to a Cu-9wt % Ni-6wt % Sn alloy (hereafter Cu9Ni6Sn) which is representative. However, it should be understood that this invention applies to other copper based alloys as well, e.g., CuNiSnSi, CuNiSi, CuCoSi, CuNiSb, CuTi, and CuMnSi, etc. alloys wherein a recrystallization texture can be achieved. Useful copper-based alloys can be characterized in that they are face centered cubic and that an equilibrium phase transformation normally occurs discontinuously at elevated aging temperature and a metastable continuous transformation occurs homogeneously at lower temperatures. These alloys are embrittled by a discontinuous equilibrium grain boundary phase ($\alpha+\gamma$) and develop their high strength from the metastable phase transformation. It may be noted that Cu-based alloys exhibiting high strain hardening rates undergo ductility exhaustion, i.e., exhibit extensive cracking, at cold work levels of about 75%, (e.g., CuBe alloys) and are not suitable.

PROCESSING

Figure 1:
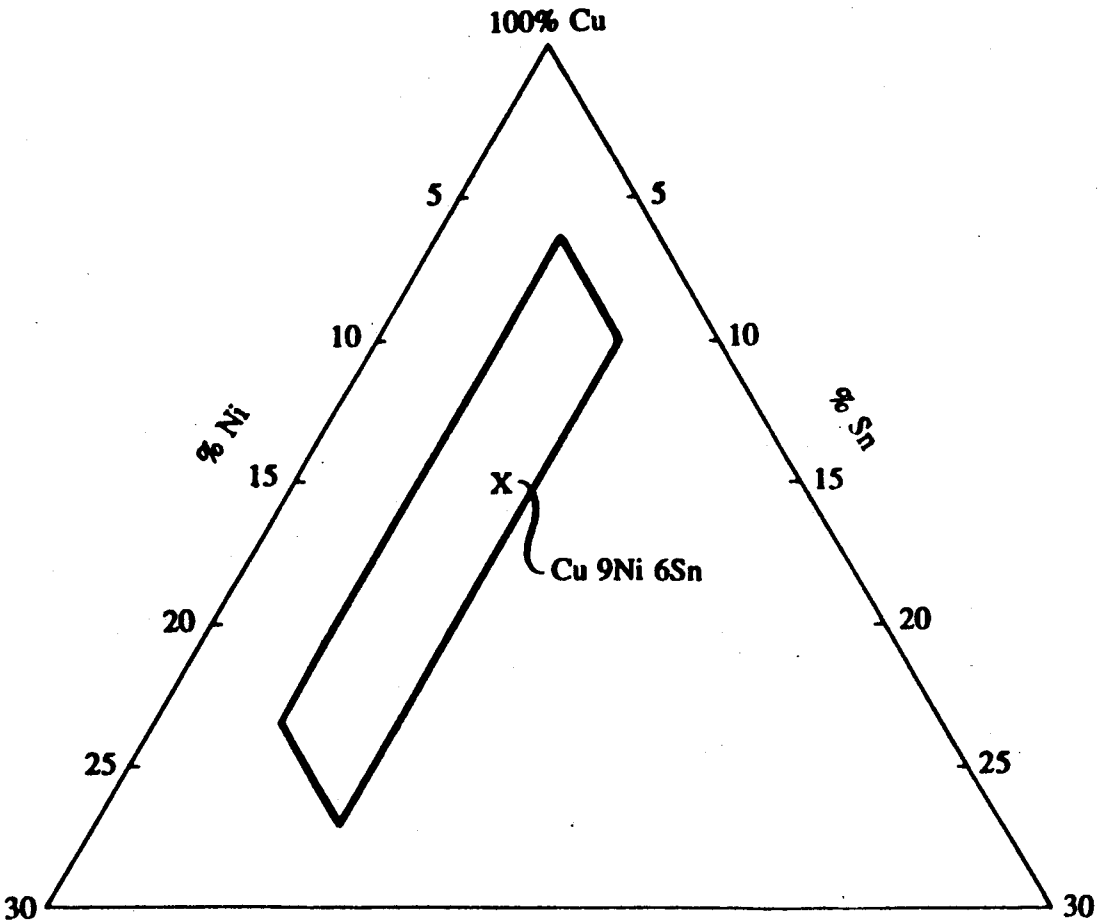
FIG. 1 is a ternary compositional diagram showing the compositions of undoped Cu-Ni-Sn alloys useful in making articles according to the invention.

In general, as a preliminary step to the novel treatment of such alloys, an ingot, e.g., a CuNiSn ingot having a composition within the useful compositional range set forth by the shaded area of FIG. 1, is subjected to a homogenization treatment such as by annealing followed by sufficient rapid cooling so as to achieve a predominantly single phase alloy. Generally this alloy is of a uniformly fine grain structure of a supersaturated solid solution of single phase $\alpha$ material. While not critical, average grain size of the homogenized ingot should preferably not exceed 0.2 mm and more preferably should be on the order of about 0.02–0.06 mm. The ingot, prior to this homogenization, may be as cast or may have undergone preliminary shaping such as by hot working, cold working or warm working. It may be noted that the term cold working as employed herein includes one or more cold working steps such as rolling, swaging, extruding, drawing, etc. uninterrupted by intermediate anneals.

Subsequent to this preliminary processing the alloy is homogenized and recrystallized by going through a heating cycle followed by a cooling cycle. The material is then cold worked to attain as large an area reduction as is practically feasible, typically $<60\%$, followed by a final recrystallization of the alloy in a manner so as to form the desired recrystallization texture. The alloy then preferably undergoes a final low level ($<35\%$ area reduction) cold working step to attain a further area reduction followed by a spinodal aging of the alloy.

This general procedure is shown schematically in FIG. 2. Referring to FIG. 2, after the pretreatment 1 which may include cold working and annealing steps, there is shown an anneal 2. The preferred anneal conditions for any suitable alloy are those which result in grain size of the material of no more than 0.2 mm and optimally from about 0.02–0.06 mm. While larger grains sizes, e.g., grain sizes of $<0.2$ mm are permissible, I have found that the smaller grain size allows for a lower level of cold work in the critical subsequent high level cold work process step 3. This second from last cold working step 3 must provide for as large an area reduction as is practically feasible, i.e., at least 60% area reduction and preferably, for Cu9Ni6Sn alloy, 80–85% area reduction. This level of cold work is not typical commercially, since most alloys will not take this level of area reduction without significant edge and surface cracking occurring. CuBe alloys typically require intermediary anneals after only 40–50%. Alloys that exhibit very low work hardening rates can be processed in this manner (CuNiSn alloys, CuNiSi alloys, CuCoSi alloys, CuNiSb alloys, etc.). We have observed that all copper alloys that exhibit spinodal decomposition appear to exhibit this low work hardening rate behavior. This step develops a very intense brass rolling texture which the prior art teaches as being undesirable in the final product. However, I have discovered that this level of cold working is necessary at this stage of the process in order to induce the desired recrystallization texture in the subsequent recrystallization step 4. The recrystallization step 4 consists of three dependent variables which influence the subsequent response of the alloy to aging. These are the recrystallization temperature, the time at temperature and the cooling rate from the recrystallization temperature to a lower temperature of typically about 300° C. Generally, the recrystallization temperature should be ±25° C. from the two phase [$\alpha$ to ($\alpha+\gamma$)] equilibrium boundary and preferably ±10° C. from this boundary. This temperature is composition dependent. The time at temperature is critical as it defines the extent of the metastable texture that develops, which in turn, influences the overaging response. The time should be such that the brass texture developed during the high level cold work step 3 transforms to a metastable recrystallization texture. Since this recrystallization texture is metastable, it must be frozen in by a sufficiently rapid cooling or quenching before it becomes random.

Figure 3:
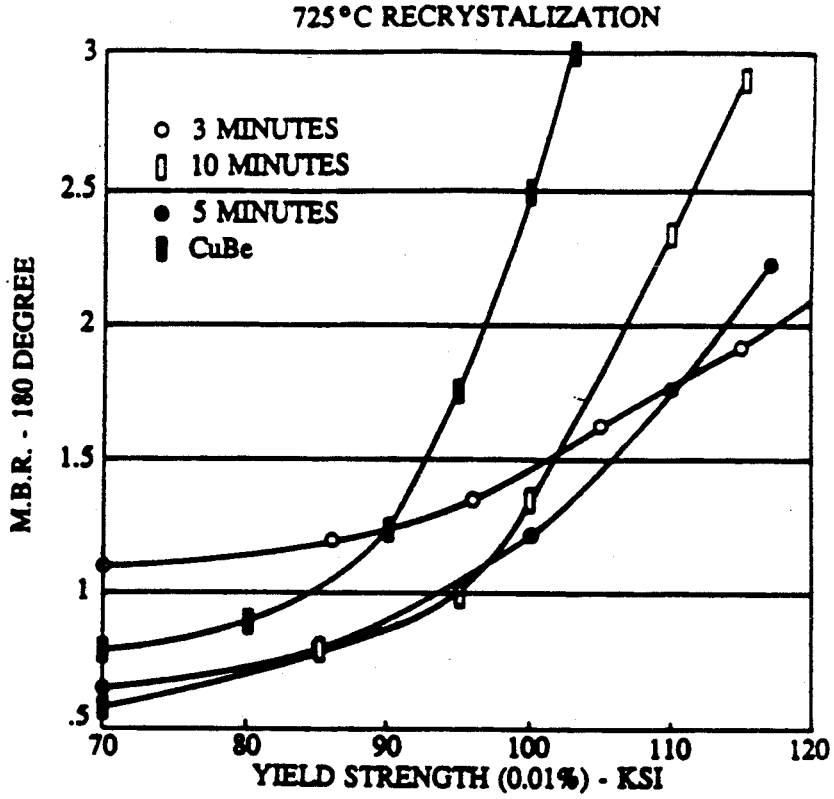
FIGS. 3–5 each show a family of curves, each curve representative of a specific recrystallization time at a recrystallization temperature of 725° C., 750° C. and 775° C. respectively. The 180° Minimum Bend Radius vs. 0.01% yield strength is plotted for a Cu-9% Ni-6% Sn alloy and a Cu-Be alloy.
Figure 4:
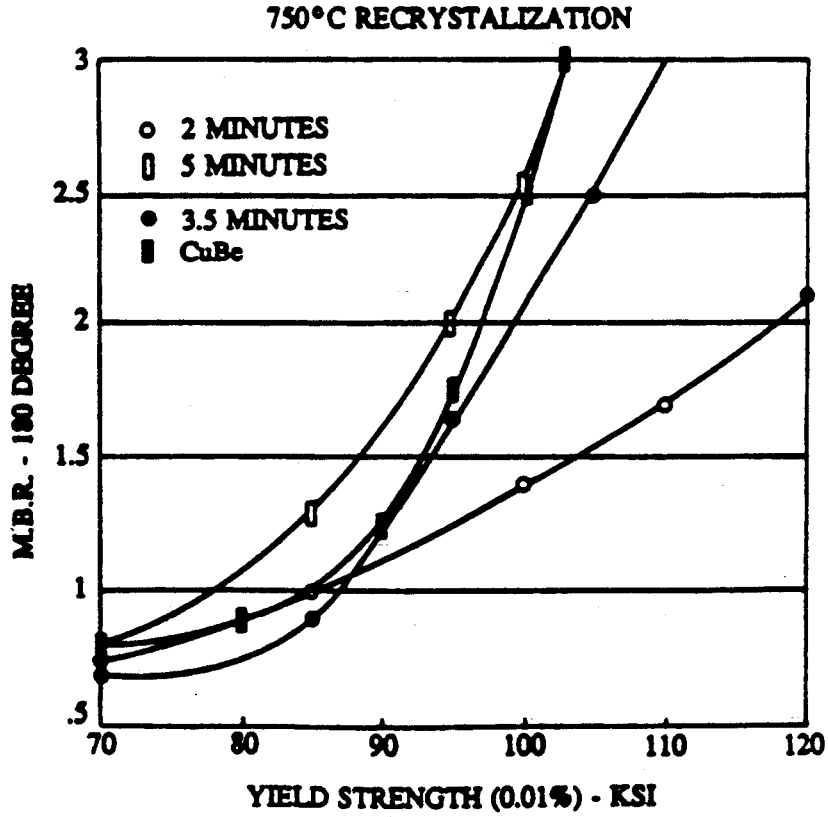
Figure 5:
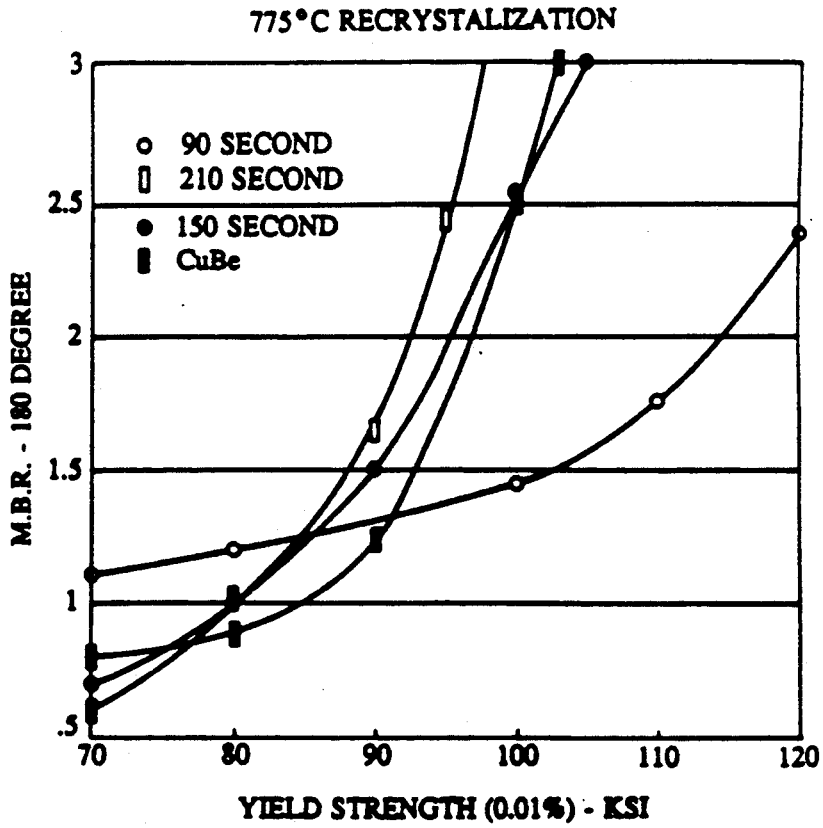
Figure 6:
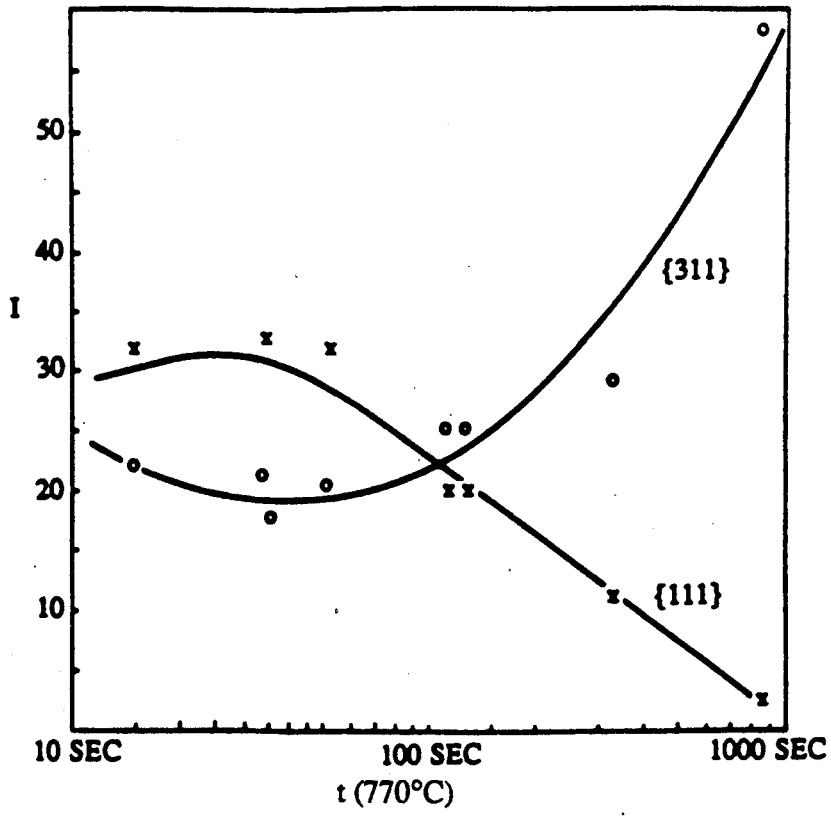
FIG. 6 shows the relative intensities of the <111> and <311> crystallographic planes of Cu9Ni6Sn alloy having 90% prior cold work as a function of recrystallization time at temperature.

Since the time at temperature is a more important variable than the total time in the furnace (a significant period of time may be required to reach temperature), it is important to specify the time at temperature for this process to be optimized. A time of 30–45 seconds at temperatures of 700°–725° C. would be optimum. This would be reduced to 10–20 seconds at 726°–750° C. At temperatures above this, times becomes so short that the metastable texture cannot be feasibly attained. (This is the reason why 7% Sn is defined as the upper boundary since at compositions in excess of this, homogenization temperatures exceed 775° C.). At lower temperatures, 675°-700° C. the annealing time (and reproducibility and ease of control) increases considerably, however, the alloy cannot be supersaturated completely. This results in reduction of the kinetics of the spinodal transformation on subsequent aging, resulting in inferior mechanical property response. The minimum time required is hence the time necessary to effect the desired recrystallization texture in a fully supersaturated alloy. Thus, the temperature window which will allow for reasonable commercially feasible processing times to achieve optimum results is probably only a 20°-30° C. range encompassing the two phase equilibrium boundary. For the Cu9Ni6Sn alloy, this optimum window is from about 710°-740° C. Viewing FIGS. 3-5, one can see the sudden increase in MBR at a fixed 0.01% yield strength; e.g., 90 ksi, and as a function of recrystallization time at various recrystallization temperatures. Data is also plotted for CuBe alloy for comparative purposes. The specific time/temperature windows can be experimentally determined for each alloy composition by utilizing x-ray diffraction peak heights vs. annealing time. A plot of such peak heights as a function of recrystallization time is shown in FIG. 6 for a Cu9Ni6Sn alloy recrystallized at between 700°-725° C.

Figure 7:
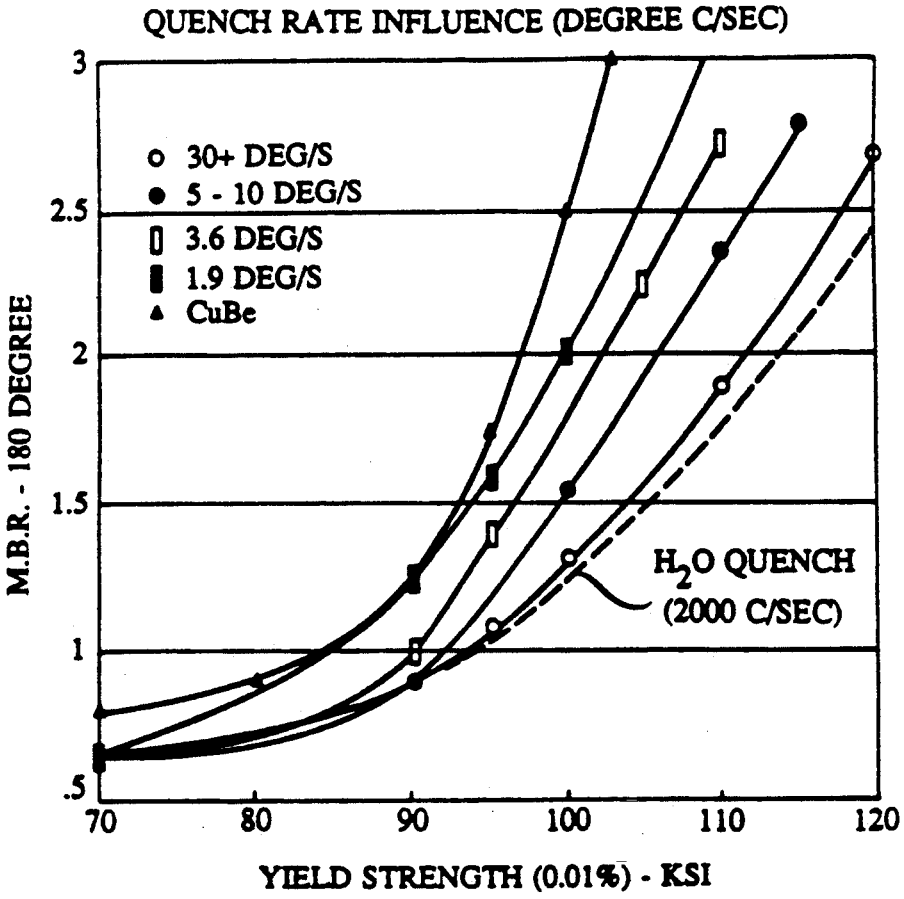
FIG. 7 is a family of curves comparing the effect of quench rates after recrystallization upon the function of 180° MBR vs 0.01% yield strength.

As indicated, after recrystallizing for the appropriate time, the sample is quenched. Quenching should be at a rate of at least about 10° C./sec. from the recrystallization temperature and preferably at a rate of at least 40° C./sec. between 700° C. and 550° C. One may quench at higher rates, e.g., by water quenching, however, above 40° C./sec. there is no significant benefit achieved. For example, FIG. 7 which shows only a minimal increase in yield strength as a function of MBR with a water quench as opposed to a 30° C./sec. quench rate.

There is evidence that, at least in some alloys, e.g., the CuNiSnSi system, it is desirable to cause homogeneous $\gamma$ nucleation on heating before recrystallization initiates. It appears that the presence of $\gamma$ particulates inhibit subsequent grain growth resulting in an extremely fine, almost micro-duplex structure and helps to preserve or increase the stability of the recrystallization texture. This structure helps to lead to an extremely high strength isotropic property response, however, it does not exhibit particularly high initial formability. The formability is improved by the subsequent recrystallization which forms a recrystallization texture and spinodal aging of the texture. The development of this $\gamma$ nucleation and attendant micro-duplex type structure appears to be dependent on the chemistry, level of prior cold work and the heating rate. If the heating rate is too high, there will be insufficient time for $\gamma$ nucleation and rapid grain growth can occur. If heating rates are too low, the $\gamma$ phase may coarsen excessively and not restrict grain boundary movement effectively. This, in turn can result in excessive grain growth. The preferred heating rate for any alloy system can be found by simple experimentation.

Subsequent to recrystallization is an optional cold work step 5 prior to final aging 6. The level of this final cold work step 5 typically can vary from 0% area reduction to an area reduction of about 35%. This is a substantially lower level of final cold work than heretofore employed in similar alloys. As this level of cold work increases from 0% to about 35% there is a concomitant increase in the subsequent aging response. Also, the strength of the alloy increases but there is an associated decrease in ductility. Hence, the degree of final cold work employed depends upon the desired final properties of the alloy. Above 35% cold work, brass texturing or fibering begins to be observed resulting in some anisotropy in formability after aging. The table shown below demonstrates the effect of final cold work prior to final aging for a Cu9Ni6Sn alloy processed in accordance with this invention as well as for material wherein the desired recrystallization texture not attained. As can be seen, the textured alloy is able to attain improved (lower) minimum bend radii as compared with nontextured alloy of the same composition. All bend data reported is taken in the transverse (bad way) direction.

| Final % cw | 0.01% Y.S. (ksi) | 180° M.B.R. (textured) | 180° M.B.R. (non-textured) |
|---|---|---|---|
| 0 | 80 ksi | 0.9 | 4 |
| 15 | 100 | 1.5 | 6 |
| 25 | 115 | 2.5 | 10 |

The final step 6 in the novel process is aging of the alloy to obtain spinodal transformation.

Step 6 is usually performed at temperatures of 275°-425° C. The higher the temperature, the faster the aging response, (important for strand aging commercially) however the resultant yield strength/ductility is reduced. The maximum aging temperature is defined by the coherent spinodal boundary for the particular composition in question. Above this temperature, spinodal decomposition will not occur. Hence the optimum property response is effected by aging at as low a temperature as is feasible commercially, usually, in the vicinity of 300° C.

Given a Cu9Ni6Sn chemistry, a 750°-800° C. pre-high level cold work anneal 2, an 85% area reduction level of cold work 3, a subsequent recrystallization 4 at about 700° C. a 17% area reduction final cold work 5 deformation, and a final 325° C. spinodal aging treatment 6 for various times, the influence of time on the aging property response can be elucidated for given recrystallization conditions. For example, the effect of aging temperature on ductility of such samples is shown in the following table:

| Aging Temp. | Aging Time | 0.01% Y.S. (ksi) | M.B.R. |
|---|---|---|---|
| 400° C. | 2 min. | 100 | 2.5 |
| 350° C. | 1 hr. | 100 | 2.0 |
| 300° C. | 17 hr. | 100 | 1.6 |

As previously indicated, for any given alloy system, there appears to be a critical compositional range over which the desired recrystallization texture can be attained. In a system consisting essentially of copper, nickel and tin, the useful alloys consist of from 3.5-20 wt % Sn and the remainder copper (with small amounts of unavoidable impurities being acceptable). Since low levels of fourth element additions can profoundly influence the recrystallization texture, it is anticipated that controlled levels of such elements may purposely be included to further develop the desired texture. I have demonstrated this by including low levels (0.15-0.3 wt %) of Si in the CuNiSn system, which has resulted in wider operating windows to achieve the desired recrystallization textured alloy.

Manipulation of the variables previously discussed causes variations in both grain size and texture. It is important to differentiate the relative influence of each with regard to the improvement in the observed mechanical properties response upon low temperature aging. To this end, experiments were performed to differentiate the influence of grain size and texture on fracture toughness in a Cu9Ni6Sn.

Fracture toughness is generally recognized as a measure of the area under the total stress strain curve in a tensile test. The larger this area, the higher the fracture toughness of the material. Samples of Cu9Ni6Sn were preliminarily processed to 0.200 inches and annealed at 825° C. for 30 minutes, followed by a water quench. With appropriate intermediate anneals, they were then processed to a final gage of 0.010 inch with the following levels of cold work; 40%, 50%, 60% 70%, 80% and 90%. All intermediate anneals were conducted at 825° C. for 15 minutes. These samples were then recrystallized at 725° C. (furnace temperature) for total times varying from 15 seconds to 850 seconds, followed by a water quench.

Figure 8:
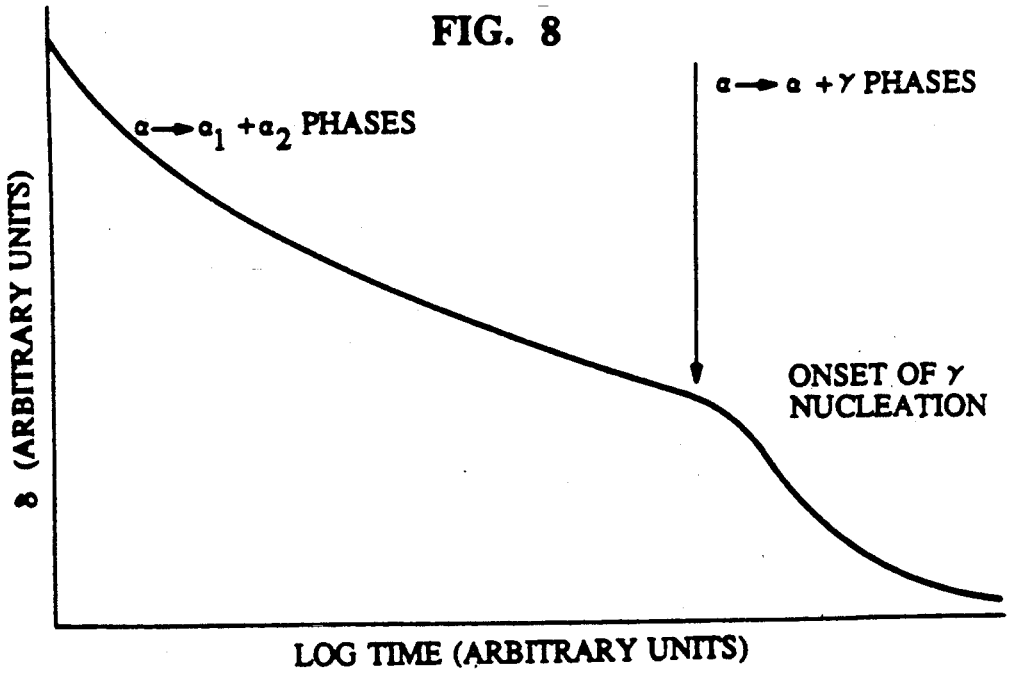
FIG. 8 is a plot of resistivity δ vs. time in arbitrary units showing the onset of γ nucleation.

The materials were then aged at 350° C. for times ranging between 1 hour and 50 hours. The samples were not given any intermediate low level cold work prior to the final age as this may tend to change the texture component and confuse interpretation of results. Samples were mechanically tested both in tension and in bending for aging times ranging between the 1 hour and 50 hours. Samples were also examined metallographically to evaluate the as-aged grain size. Conductivity measurements were also made throughout the aging sequence. The conductivity change in spinodal alloys has been the subject of several papers. The onset of the $\alpha+\gamma$ grain boundary reaction is clearly observed as a discontinuity in the resistivity vs. log aging time profile (FIG. 8), and in conjunction with the mechanical overaging/embrittlement plot. These profiles allow good confirmation for the degree of the inhibition to cracking occurring due to the presence of the preferred recrystallization texture.

Fracture toughness can be calculated from the MBR and the tensile test in the following manner:

$$F.T. = \left(\frac{0.2\%\ Y.S. + U.T.S.}{2}\right)(\text{total strain fracture})$$

and $R/_{\tau}=MBR=[1/(1+\epsilon_{\tau}^2)-1]$ where $\epsilon_{\tau}$ is total strain to fracture $$\epsilon_{\tau} = \left(\sqrt{\frac{1}{R/\tau}+1} - 1\right)$$

$$F.T. \approx (0.2\%\ Y.S.)\left(\sqrt{\frac{\tau}{R}+1} - 1\right)$$

Figure 9:
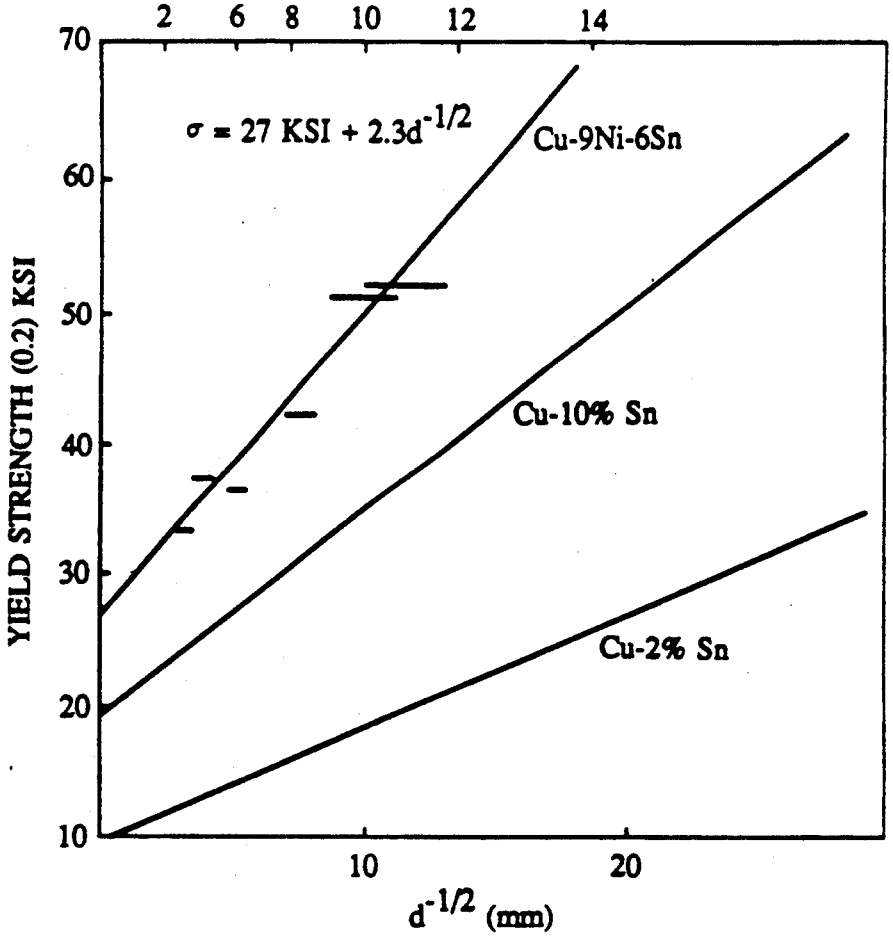
FIG. 9 is a plot of Petch hardening for Cu9Ni6Sn alloy.

FIG. 9 shows the Petch hardening observed for the variations in grain size developed over the range of times of recrystallization for the different levels of prior cold work investigated. The range of ASTM grain sizes observed was from 3–11. Over this range is grain sizes, the yield strength (0.2%) ranged from 33 to 51 ksi in the as annealed material. The MBR values show a slight monotonic increase, exhibiting values from 0.4 to 0.6 over the same range. These measurements were somewhat obscured due to an extreme orange peel observed for the largest grain sizes. It is clear, however, that the fracture toughness varies a maximum of no more than 20% over the range of grain sizes investigated. This implies that ductility is consumed as the yield strength is increased, while fracture toughness is conserved.

Accordingly, any significant variations in fracture toughness in excess of 20% on subsequent aging would imply an intrinsic difference in the material in question, and would be a consequence of some variable, other than grain size.

Figure 10:
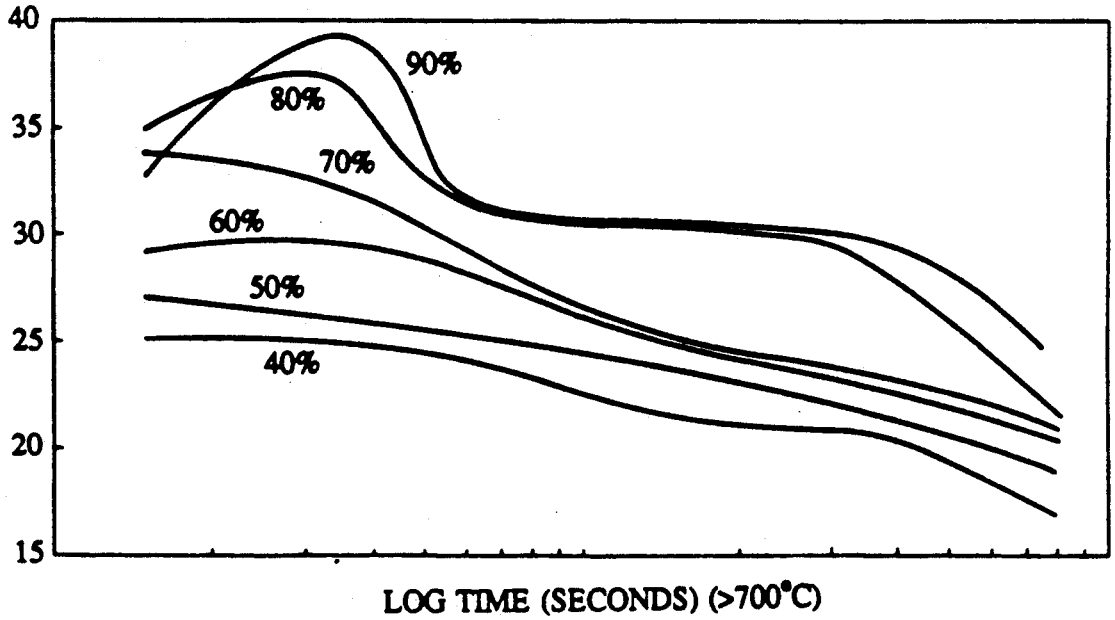
FIG. 10 is a plot of fracture toughness as a function of recrystallization time for different levels of cold work.

In FIG. 10, the fracture toughness values are shown for a 4 hour 350° C. aging cycle. Fracture toughness is plotted against recrystallization time for the difference levels of prior cold work indicated. The 80 and 90% prior deformation samples exhibit a maxima in fracture toughness value which occurs for annealing times of 30–40 seconds. All other levels of cold work show a monotonic decrease in fracture toughness as the time increases. The level of fracture toughness decreases at any level of recrystallization time as the level of cold work decreases. The effect is considerable (ranging from a high 39 to a low of 17) and is significantly greater than could be anticipated from a simple grain size refinement argument. A further indication that the recrystallization texture effect is real is suggested by the fact that for any given curve, grain size decreases monotonically: the discontinuities indicated in the 80 to 90% curves are hence anomalous.

Figure 11:
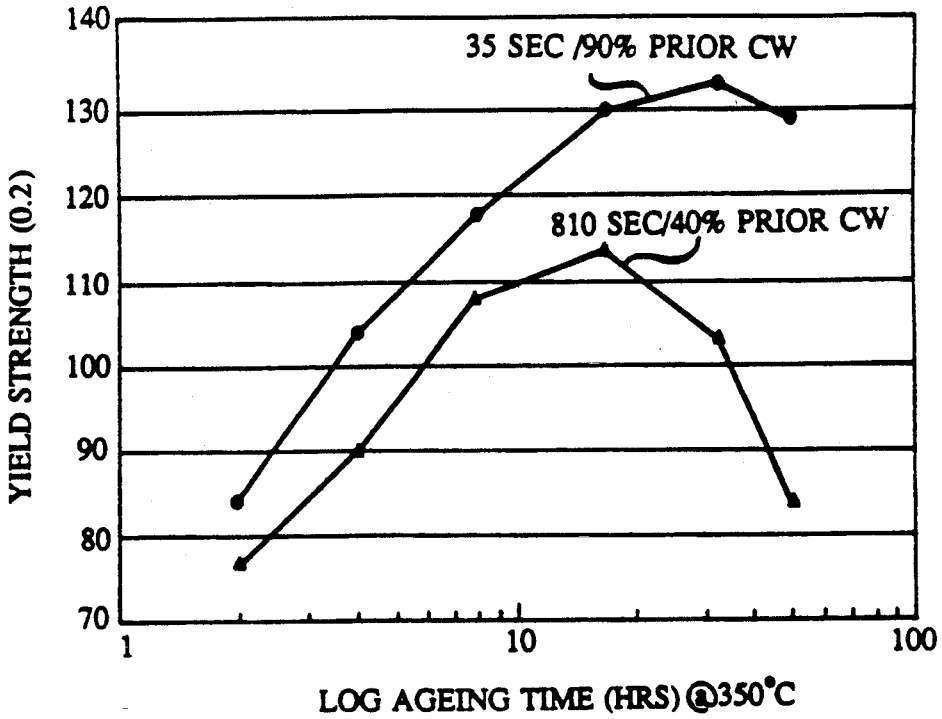
FIG. 11 is a plot of 0.2% yield strength versus log of the aging time at 350° C. for different levels of cold work.

FIG. 11 indicates the suppression of the overaging behavior and the added benefit in yield strength observed due to this suppression. In this case the optimum 35 second 90% cold worked condition is compared to a 13 minute 40% prior cold worked material. The latter is typical of a commercially processed material. There is almost 20 ksi increase in yield maxima between these conditions, and the embrittlement is suppressed by a factor of two in time.

Figure 12:
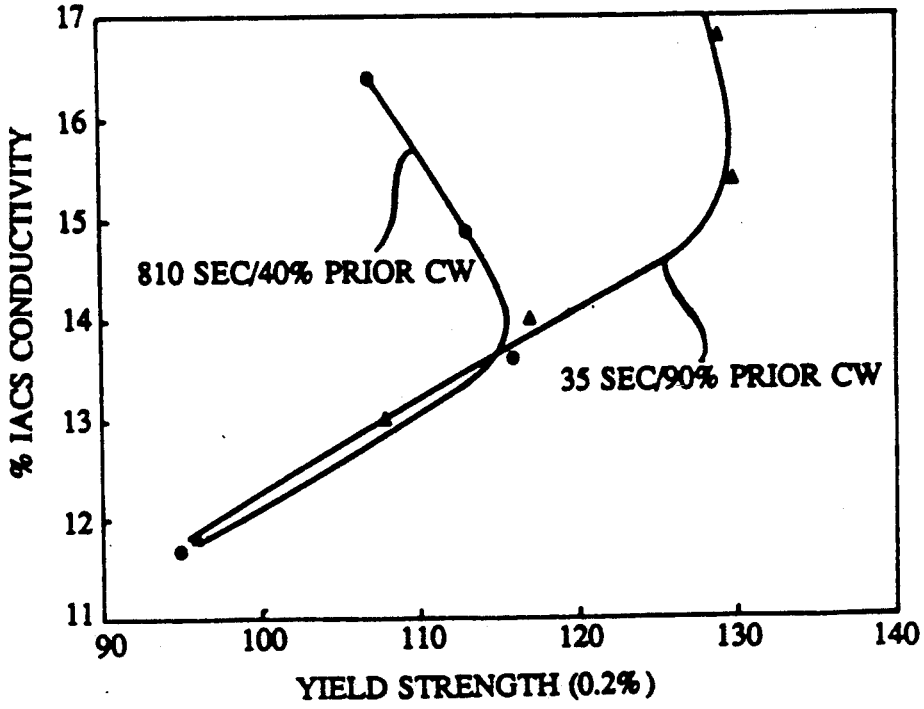
FIG. 12 is a plot of 0.2% yield strength versus percent IACS conductivity of the same samples used in FIG. 11.

FIG. 12 shows the same two materials as in FIG. 11 in the form of yield strength conductivity curves. Since the onset of nucleation of the $\alpha+\gamma$ is inhibited to longer times, the spinodal transformation can continue to a greater extent, increasing yield strength and increasing conductivity. The conductivity at about maximum yield strength is raised from 13.5 to 16% IACS.

Figure 13:
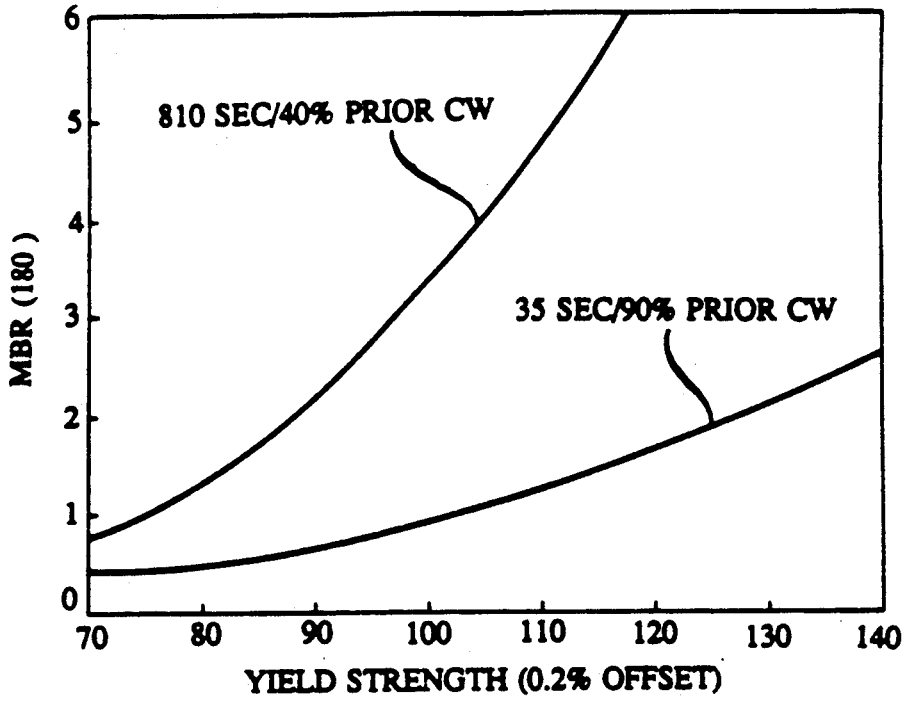
FIG. 13 indicates yield strength as a function of 180° MBR for these same samples.

FIG. 13 indicates the data for these two conditions in the form of yield strength MBR curves. This type of curve is of the greatest commercial importance as it allows the designer to determine the maximum yield for a given forming radius in a design. The data when presented in this format show dramatic differences. The preferred treatment allows for very significant increases in yield strength for a given forming radius. For example, for a MBR of two, optimization of the processing allows an increase of yield strength from 88 ksi to 127 ksi.

Figure 14:
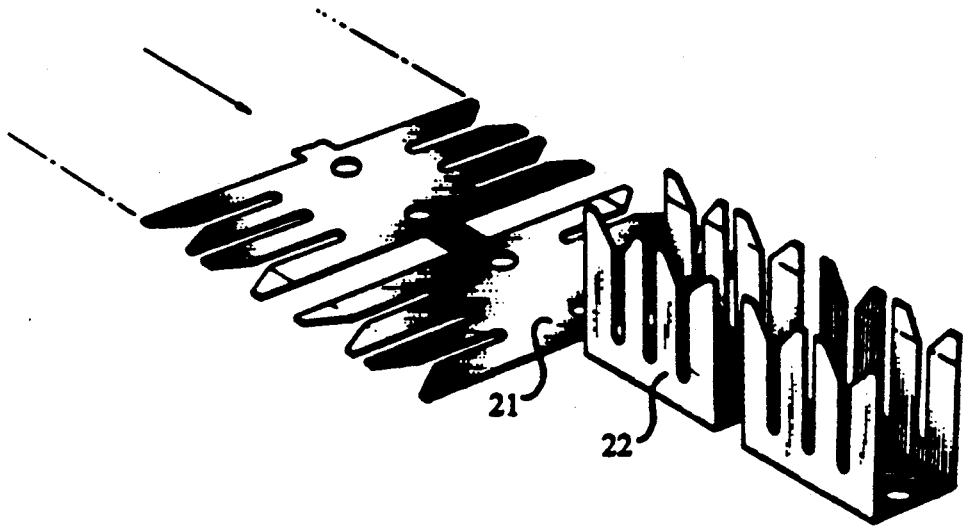
FIG. 14 shows a Cu-Ni-Sn alloy strip manufactured in accordance with the disclosed method to give the desired recrystallization texture and which has undergone forming operations such as stamping and bending.

FIG. 14 shows a strip one half inch wide and 25 mils thick made from a Cu9Ni6Sn alloy processed in accordance with this invention. The strip is shown processed as in the manufacture of electrical connectors. Specifically, portion 21 of the strip is shown perforated and notched by stamping and portion 22 is shown bent sharply in a direction transverse to the rolling direction which is indicated by an arrow.

It should be understood that while it has been observed that the processing steps which lead to the formation of alloys having improved isotropic formability at a given yield strength concomitantly results in the enhancement of the one crystallographic orientation and lowering of the another orientation. The presence of such crystallographic orientations are merely hypothesized as indicative of the formation of suitable materials. Hence, the processing and articles resulting therefrom as set forth, should not be limited by this observation and hypothesis concerning the crystallographic orientation enhancement.

What is claimed is:

1. A method of processing a copper-based metallic alloy comprising 3–20 wt. % Ni, 3.5–7 wt. % Sn, 0.15 to 0.3 wt. % Si and the balance substantially of copper to form an article such that said alloy of said article is an essentially isotropically formable spinodal material having a preferred recrystallization texture comprising the steps of:

1) annealing said alloy by heating said alloy and cooling the alloy sufficiently rapidly to achieve a predominantly single phase alloy;
2) cold working the cooled alloy to obtain area reduction of at least 60%;
3) recrystallizing said cold worked alloy under conditions to form a recrystallization texture; and
4) aging said recrystallized alloy to obtain spinodal transformation.

2. The method recited in claim 1 including the step of cold working said alloy to achieve an area reduction of up to 35% subsequent to recrystallization and prior to aging.

3. The method recited in claim 1 wherein the alloy consists essentially of 3–20 wt. % Ni, 3.5–7 wt. % Sn, 0.15–0.3 wt. % Si and the balance copper.

4. The method recited in claim 1 wherein said alloy consists of 3–20 wt. % Ni, 3.5–7 wt. % Sn 0.15–0.3 wt. % Si and the balance copper.

5. The process of claim 1 wherein said alloy is annealed at a temperature in the range 750° C.–800° C.

6. The process of claim 1 wherein the cooled alloy is cold worked to attain an area reduction in the range 80–85%.

7. The process of claim 1 wherein said alloy is recrystallized by a) heating said alloy to a temperature within 25° C. of the two-phase equilibrium boundary for a time sufficient to transform the brass texture formed by cold working to a metastable recrystallization texture and b) cooling said alloy sufficiently rapidly to freeze the metastable recrystallization texture.

8. The process of claim 1 wherein said alloy is spinodally aged at a temperature in the range of 275° C.–425° C.

9. An article of manufacture made by the process of claim 1.

10. The article recited in claim 9 wherein said alloy further comprises an additive selected from the group consisting of Si, Ti, Hf, Zr, the lanthanide elements, Fe, and Co.

11. The article recited in claim 9 wherein said alloy consists essentially of about 9 wt % Ni, 6 wt % Sn, 0.15 to 0.3 wt. % Si and the balance substantially being Cu.

12. The article recited in claim 9 wherein said article is an electrical connector.

13. The article of claim 9, said alloy comprising 3 to 20 weight percent Ni, 3.5 to 7 weight percent Sn, 0.15 to 0.3 weight percent Si, 0 to 0.3 weight percent of an additive selected from the group consisting of Si, Ti, Hf, Zr, and the lanthanide elements, individually or in combination, 0 to 1.5 weight percent of an additive selected from the group consisting of Fe and Co, individually or in combination, not more than 5 weight percent Mn, not more than 25 weight percent Zn, not more than 3 weight percent Al, not more than 1 weight percent Mg, and remainder essentially Cu.

14. A method for forming an article of manufacture from a copper-based metallic alloy comprising 3–20 wt. % Ni, 3.5–7 wt. % Sn and 0.15–0.3 wt. % Si comprising the steps of:

a) homogenizing the alloy to form an essentially uniform fine grain structure of a supersaturated solid solution of single phase $\alpha$ alloy having an average grain size of no more than 0.2 mm;
b) cold working the homogenized alloy to obtain an area reduction of at least 60% without intermediate anneals;
c) recrystallizing the alloy at a temperature of ±25° C. from the two phase equilibrium boundary for a time sufficient to develop a metastable recrystallization texture and essentially eliminate any brass texture formed during cold work;
d) quenching immediately after recrystallization;
e) aging the alloy to obtain spinodal transformation such that said alloy is essentially isotropically formable.

15. The method recited in claim 14 including the step of cold working the alloy to achieve an area reduction without the development of a brass texture immediately prior to aging.

16. The method recited in claim 14 including the step of shaping said article of manufacture from said formable spinodal alloy.

* * * * *